US008692191B2

(12) United States Patent
Kou

(10) Patent No.: US 8,692,191 B2
(45) Date of Patent: Apr. 8, 2014

(54) MASS SPECTROMETER

(75) Inventor: Junkei Kou, Akishima (JP)

(73) Assignee: JEOL Ltd., Tokyo (JP)

( * ) Notice: Subject to any disclaimer, the term of this patent is extended or adjusted under 35 U.S.C. 154(b) by 187 days.

(21) Appl. No.: 13/332,438

(22) Filed: Dec. 21, 2011

(65) Prior Publication Data

US 2012/0160998 A1 Jun. 28, 2012

(30) Foreign Application Priority Data

Dec. 27, 2010 (JP) ..... 2010-290100

(51) Int. Cl.
*H01J 49/00* (2006.01)

(52) U.S. Cl.
USPC ..... 250/288; 250/281; 250/423 R

(58) Field of Classification Search
USPC ..... 250/281, 288, 287, 282, 396 R
See application file for complete search history.

(56) References Cited

U.S. PATENT DOCUMENTS 6,107,623 A * 8/2000 Bateman et al. ..... 250/282
6,285,027 B1 * 9/2001 Chernushevich et al. .... 250/287
6,545,268 B1 * 4/2003 Verentchikov et al. ..... 250/287
6,670,606 B2 * 12/2003 Verentchikov et al. ..... 250/287
7,388,194 B2 * 6/2008 Schneider et al. ..... 250/288
7,405,397 B2 * 7/2008 Covey et al. ..... 250/288
2002/0148972 A1 * 10/2002 Krutchinsky et al. ..... 250/396 R
2003/0141447 A1 * 7/2003 Verentchikov et al. ..... 250/287

FOREIGN PATENT DOCUMENTS

JP 2010127714 A 6/2010

OTHER PUBLICATIONS

G.G. Dolnikowski et al., "Ion-Trapping Technique for Ion/Molecule Reaction Studies in the Center Quadrupole of a Triple Quadrupole Mass Spectrometer", International Journal of Mass Spectrometry and Ion Processes, (1988), pp. 1-15, 82.

* cited by examiner

*Primary Examiner* — Nikita Wells
*Assistant Examiner* — Johnnie L Smith
(74) *Attorney, Agent, or Firm* — The Webb Law Firm

(57) ABSTRACT

A mass spectrometer having first and second mass analyzers for selecting first and second desired ions and a controller that provides control such that those of the first desired ions which have larger masses have larger kinetic energies in the direction of the optical axis in the first mass analyzer and that those of the second desired ions which have larger masses have larger kinetic energies in the direction of the optical axis in the second mass analyzer.

17 Claims, 6 Drawing Sheets

MASS SPECTROMETER

BACKGROUND OF THE INVENTION

1. Field of the Invention

The present invention relates to a mass spectrometer and, more particularly, to a triple quadrupole mass spectrometer.

2. Description of Related Art

A quadrupole mass spectrometer is a mass spectrometer for passing only ions of desired mass-to-charge ratios by applying an RF voltage and a DC voltage to hyperbolic quadrupole rods. A triple quadrupole mass spectrometer consisting of two such quadrupole mass spectrometers connected together have been often used in structural analysis and quantitative analysis in recent years because the specificity and quantitativeness are improved compared with a single quadrupole mass spectrometer. In a triple quadrupole mass spectrometer, ions generated in an ion source pass through an ion guide and enter a first mass analyzer, where desired ions are selected by a quadrupole mass filter. The ions (precursor ions) selected by the first mass analyzer are guided to a collision cell, where the ions collide with gaseous molecules. Consequently, the ions are fragmented with some probability. The precursor ions and fragment ions (product ions) pass through the collision cell and only desired ions are selected by a quadrupole mass filter in a second mass analyzer and detected by a detector.

Usually, in a triple quadrupole mass spectrometer, during the process of transporting ions from the ion source to the detector, an ion storing step is not performed. However, in the technique disclosed in "Ion-Trapping Technique for Ion/Molecule Reaction Studies in the Center Quadrupole of a Triple Quadrupole Mass Spectrometer", G. G. Dolnikowski, M. J. Kristo, C. G. Enke and J. T. Watson, International Journal of Mass Spectrometry and Ion Processes 82 (1988) 1-15., high sensitivity is realized by storing ions in a collision cell, then ejecting the ions to create pulsed ions, and recording the maximum intensity of the pulsed ions. JP-A-2010-127714 describes a method of accomplishing high sensitivity in a triple quadrupole mass spectrometer by ejecting ions stored either in a collision cell or in an ion guide placed ahead of the first mass analyzer to create pulsed ions and recording the areal intensity.

It is pointed out that the triple quadrupole mass spectrometer where ions are pulsed by performing an ion-storing operation in this way can provide improved sensitivity. However, there is the problem that producing pulsed ions complicates the setting of timings at which various portions of the instrument operate. For example, where pulsed ions are produced by storing and ejecting ions by an ion guide located upstream of the first mass analyzer, the ions selected by the first and second mass analyzers must be changed during the interval between the instants at which two successive pulsed ions pass through the mass analyzers. The timing at which ions selected by a mass analyzer is changed can be given by some delay time introduced after the ejection of the previous pulsed ion. However, the flight velocity of a pulsed ion usually depends on the mass-to-charge ratio and so the delay time must be varied according to the mass-to-charge ratio in order to prevent the analysis velocity from decreasing. Consequently, the timing control is more complicated.

SUMMARY OF THE INVENTION

In view of the foregoing problem, the present invention has been made. Some aspects of the invention can provide a mass spectrometer capable of facilitating controlling the timing at which selected ions are changed by each mass analyzer.

A mass spectrometer associated with the present invention includes: an ion source for ionizing a sample to create ions; an ion storage portion for storing the created ions and ejecting the stored ions as pulsed ions; a first mass analyzer for selecting first desired ions from the pulsed ions ejected from the storage portion based on mass-to-charge ratio; a collision cell for fragmenting some or all of the first desired ions into product ions; a second mass analyzer for selecting second desired ions from the first desired ions and the product ions based on mass-to-charge ratio; a detector for detecting the second desired ions; and a controller for providing control such that those of the first desired ions which have larger masses have larger kinetic energies in the direction of an optical axis in the first mass analyzer and that those of the second desired ions which have larger masses have larger kinetic energies in the direction of the optical axis in the second mass analyzer.

In the related art technique, in the first and second mass analyzers, the kinetic energies of the first and second desired ions in the direction of the optical axis are controlled to be constant irrespective of mass-to-charge ratio and, therefore, first or second desired ions of larger masses have smaller flight velocities and it takes longer for them to pass through the first or second mass analyzer irrespective of mass-to-charge ratio. According to the present invention, in each of the first and second mass analyzers, ions having larger masses are made to have larger kinetic energies in the direction of the optical axis. Consequently, the times taken for ions to pass through the first or second mass analyzer can be made substantially constant. Accordingly, the timing at which ions selected by the first or second mass analyzer are varied can be controlled with greater ease.

In one embodiment of this mass spectrometer, the controller may vary the axial voltage on the first mass analyzer according to the mass-to-charge ratio of the first desired ions to thereby vary the kinetic energies of the first desired ions in the direction of the optical axis. The controller may vary the axial voltage on the second mass analyzer according to the mass-to-charge ratio of the second desired ions to thereby vary the kinetic energies of the second desired ions in the direction of the optical axis.

By modifying the axial voltages on the first and second mass analyzers in this way, the kinetic energies of the ions selected by the analyzers in the direction of the optical axis can be easily varied to desired values.

Preferably, this mass spectrometer may vary the axial voltage on the first mass analyzer based on a mathematical formula or table indicating a relationship between the mass-to-charge ratio of the first desired ions and the axial voltage on the first mass analyzer. The mass spectrometer may also vary the axial voltage on the second mass analyzer based on a mathematical formula or table indicating a relationship between the mass-to-charge ratio of the second desired ions and the axial voltage on the second mass analyzer.

Consequently, the axial voltages on the first and second mass analyzers can be controllably varied with greater ease.

Preferably, in this mass spectrometer, in a case where the first mass analyzer selects different ones of the first desired ions in response to two pulsed ions ejected in succession from the ion storage portion, the controller provides control such that an instant at which the selection of the first desired ions is started to be varied is later than an instant at which a previous pulsed ion finishes passing through the first mass analyzer and that an instant at which the selection of the first desired ions ends is earlier than an instant at which a following pulsed ion starts to pass through the first mass analyzer.

In a case where the second mass analyzer selects different ones of the second desired ions in response to two pulsed ions entering in succession from the collision cell, the controller provides control such that an instant at which the selection of the second desired ions is started to be varied is later than an instant at which a previous pulsed ion finishes passing through the second mass analyzer and that an instant at which the selection of the second desired ions ends is earlier than an instant when a following pulsed ion starts to pass through the second mass analyzer.

In consequence, during the variation of the ions selected by the first or second mass analyzer, pulsed ions can be prevented from entering the mass analyzer and thus ion loss can be suppressed. Furthermore, since the axial voltage can be kept constant while pulsed ions are passing through the first or second mass analyzer, the times taken for all the selected ions to pass through the mass analyzers can be made almost constant.

Preferably, in this mass spectrometer, the ion storage portion may store the ions created by the ion source and eject the stored ions as pulsed ions at regular intervals of time.

In this instrument, when the ion storage portion performs only one ion ejection operation for each transition, individual transitions can be compared in terms of intensity.

Preferably, in this mass spectrometer, the collision cell may store the first desired ions and the product ions and eject the stored ions as pulsed ions.

Widthwise spread of the pulsed ions impinging on the detector can be suppressed by storing ions in the collision cell and ejecting the pulsed ions in this way. Therefore, the detection sensitivity can be improved further. The fragmentation efficiency in the collision cell can be enhanced because ions impinging on the collision cell are once stored in the cell.

Preferably, in this mass spectrometer, the ion storage portion stores the ions created by the ion source and ejects the stored pulses as pulsed ions at regular intervals of time. The collision cell stores the first desired ions and the product ions and ejects the stored ions as pulsed ions at regular intervals of time which may be equal to the first-mentioned intervals of time.

In this configuration, when each of the ion storage portion and the collision cell performs the ion ejection operation once for each transition, individual transitions can be compared in terms of intensity.

Preferably, in this mass spectrometer, when the first mass analyzer varies the mass-to-charge ratio of the first desired ions, the collision cell may eject all of ions present in the cell by an operation for ejecting the last pulsed ion prior to the variation.

Interference (crosstalk) between transitions can be suppressed by ejecting all the ions remaining in the collision cell in this way.

Preferably, in this mass spectrometer, in a case where the first mass analyzer varies the mass-to-charge ratio of the first desired ions, the collision cell may make longer a time for which the last pulsed ion prior to the variation is ejected than a time for which other pulsed ions are ejected prior to the variation.

By setting longer the time in which the last pulsed ion prior to the variation of the mass-to-charge ratio of the first desired ions is ejected in this way, ion interference (crosstalk) between transitions can be reduced.

Preferably, in this mass spectrometer, the collision cell may store the first desired ions and the product ions while the first desired ions are entering the cell.

In this configuration, all of the first desired ions are stored in the collision cell and so the fragmentation efficiency in the collision cell can be enhanced.

Preferably, in this mass spectrometer, the first mass analyzer may include a first quadrupole mass filter for selecting the first desired ions, and the second mass analyzer may include a second quadrupole mass filter for selecting the second desired ions.

Preferably, in this mass spectrometer, the first mass analyzer may include at least one of a pre-filter and a post-filter located respectively before and after the first quadrupole mass filter. The second mass analyzer may include at least one of a pre-filter and a post-filter located respectively before and after the second quadrupole mass filter.

Other features and advantages of the present invention will become apparent from the following more detailed description, taken in conjunction with the accompanying drawings, which illustrate, by way of example, the principles of the invention.

DESCRIPTION OF THE PREFERRED EMBODIMENTS

The preferred embodiments of the present invention are hereinafter described in detail with reference to the drawings. It is to be understood that the embodiments described below do not unduly restrict the contents of the present invention delineated by the appended claims and that all the configurations described below are not always essential constituent components of the invention.

1. First Embodiment

(1) Configuration

The configuration of a mass spectrometer according to a first embodiment of the present invention is first described. This spectrometer is a so-called triple quadrupole mass spectrometer. One example of its configuration is shown in FIG. 1, which is a schematic vertical cross section of the spectrometer.

Figure 1:
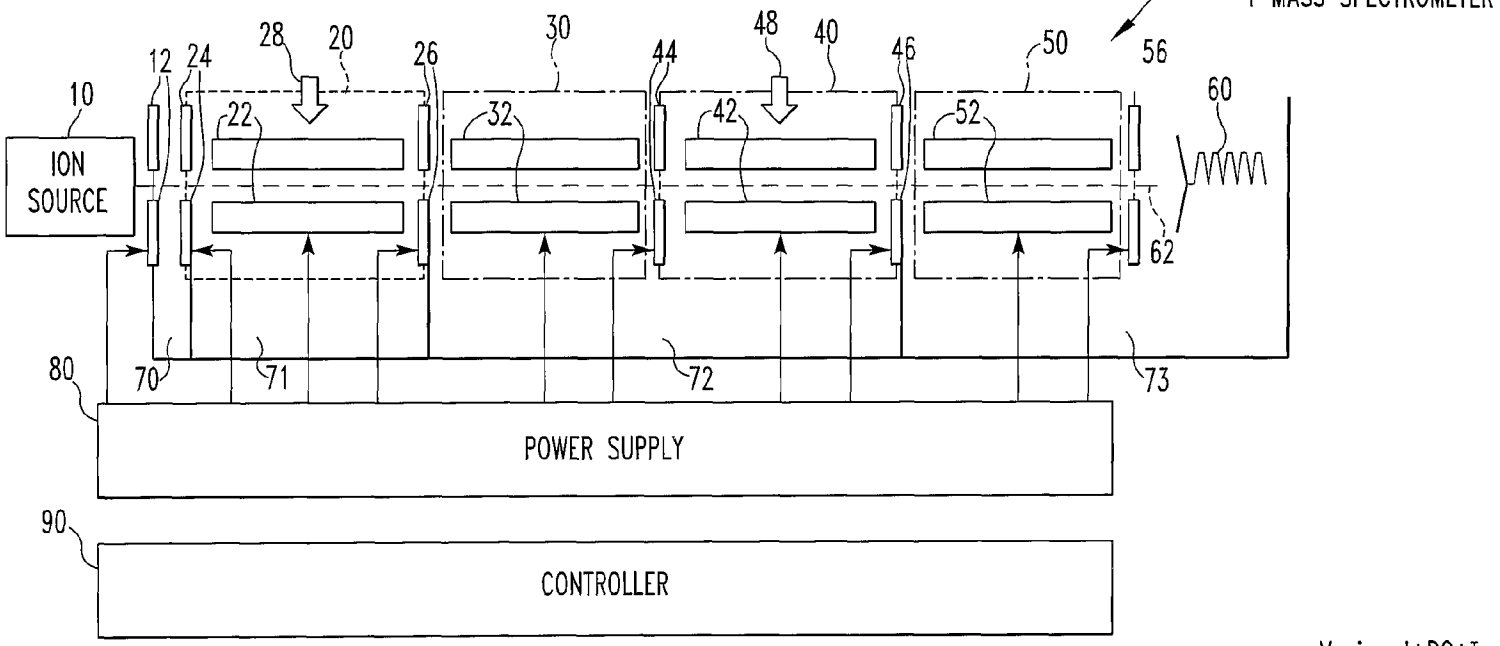
FIG. 1 is a diagram showing the configuration of a mass spectrometer according to a first embodiment of the present invention.

As shown in FIG. 1, the mass spectrometer according to the first embodiment of the present invention is generally indicated by reference numeral 1 and configured including an ion source 10, an ion storage portion 20, a first mass analyzer 30, a collision cell 40, a second mass analyzer 50, a detector 60, a power supply 80, and a controller 90. The mass spectrometer of the present embodiment may be configured such that some of the components of the instrument of FIG. 1 are omitted.

The ion source 10 ionizes a sample introduced from a sample inlet device such as a chromatograph (not shown) by a given method. The ion source 10 can be realized as a continuous atmospheric-pressure ion source that creates ions continuously, for example, using an atmospheric-pressure ionization method such as ESI.

An electrode 12 having a central opening is mounted behind the ion source 10. The ion source portion 20 is mounted behind the electrode 12.

The ion storage portion 20 is configured including an ion guide 22, an entrance electrode 24, and an exit electrode 26. The electrodes 24 and 26 are located at the opposite ends of the ion guide 22. The storage portion 20 has gas inlet device 28 such as a needle valve for introducing gas from the outside. The ion guide 22 is formed using a quadrupole, a hexapole, or other multipole. Each of the entrance electrode 24 and exit electrode 26 is centrally provided with an opening. The storage portion 20 repeatedly performs a storage operation for storing the ions created by the ion source 10 and an ejection operation for ejecting the stored ions as pulsed ions.

The first mass analyzer 30 including a quadrupole mass filter 32 is mounted behind the ion storage portion 20. The first mass analyzer 30 selects first ions from the pulsed ions ejected by the storage portion 20 based on their mass-to-charge ratio (m/z) and passes pulsed ions including the first ions. In particular, the first mass analyzer 30 selects and passes ions having an m/z ratio corresponding to selection voltages (RF voltage and DC voltage) applied to the quadrupole mass filter 32. The ions selected by the first mass analyzer 30 are termed precursor ions.

The collision cell 40 is mounted behind the first mass analyzer 30 and includes an ion guide 42, an entrance electrode 44, and an exit electrode 46. The electrodes 44 and 46 are mounted at opposite ends of the ion guide 42. The cell 40 has gas inlet means 48 (such as a needle valve) for introducing gas such as helium or argon from the outside. Each of the electrodes 44 and 46 is centrally provided with an opening. The precursor ions are fragmented with some probability by collision with gaseous molecules by introducing the gas into the collision cell 40. In order that the precursor ions fragment, the collisional energy must be higher than the dissociation energy of the precursor ions. This collisional energy is substantially equal to the potential energy difference due to the potential difference between the axial voltage on the ion guide 22 and the axial voltage on the ion guide 42. The ions fragmented by the collision cell 40 are known as product ions.

The second mass analyzer 50 including a quadrupole mass filter 52 is mounted behind the collision cell 40. The second mass analyzer 50 selects second ions from the pulsed ions ejected by the collision cell 40 based on mass-to-charge ratio, and passes pulsed ions including the second ions. Specifically, the second mass analyzer 50 selects and passes ions with mass-to-charge ratios corresponding to the selection voltages (RF voltage and DC voltage) applied to the quadrupole mass filter 52.

An electrode 56 centrally provided with an opening is mounted behind the second mass analyzer 50. The detector 60 is mounted behind the electrode 56. The detector 60 detects pulsed ions passed through the second mass analyzer 50 and outputs an analog signal corresponding to the intensity of the detected ions. The analog signal outputted from the detector 60 is sampled by an A/D converter (not shown) and converted into a digital signal. The digital signal is finally stored as ion intensities in the memory of a personal computer that communicates with the quadrupole mass spectrometer 1.

The combination of the mass-to-charge ratio of ions selected by the first mass analyzer 30 and the mass-to-charge ratio of ions selected by the second mass analyzer 50 is known as a transition. Normally, transitions are used for combinations of ions in a multiple reaction mode (MRM) where selected ions are fixed both in the first mass analyzer 30 and in the second mass analyzer 50. However, combinations of mass-to-charge ratios of ions selected by the first mass analyzer 30 and the second mass analyzer 50 at an instant of time can be defined for product ion scans where scans are made by the second mass analyzer 50, precursor ion scans where scans are made by the first mass analyzer 30, and neutral loss scans where scans are made by both mass analyzers and, therefore, the term "transitions" are employed also in these cases.

Where only one pulsed ion is ejected from the ion storage portion 20 for each transition, the integrated intensity of each pulsed ion impinging on the detector 60 is the ion intensity for each transition. Assuming that the period at which the exit electrode 26 of the ion storage portion 20 begins to be opened is constant, the ion intensity of each transition is in proportion to the amount of precursor ions produced by the ion source 10 during a given period, i.e., during a given period for which the exit electrode is open. As a result, ions created at regular intervals of time by the ion source 10 are observed for whatever transition. Consequently, individual transitions can be compared in terms of intensity.

A first differential pumping chamber 70 is formed by the space between the electrode 12 and the entrance electrode 24 of the ion storage portion 20. A second differential pumping chamber 71 is formed by the space between the entrance electrode 24 of the storage portion 20 and the exit electrode 26. A third differential pumping chamber 72 is formed by the space between the exit electrode 26 of the storage portion 20 and the exit electrode 46 of the collision cell 40. A fourth differential pumping chamber 73 is formed by the space formed behind the exit electrode 46 of the collision cell 40.

The power supply 80 applies desired voltages to the electrodes 12, 24, 26, 44, 46, 56, ion guides 22, 42, and quadrupole mass filters 32, 52 independently or in an interlocking manner so that ions with desired transitions are selected from the ions created by the ion source 10 and reach the detector 60. The controller 90 controls the timing at which the voltages applied by the power supply 80 are switched.

The ion transport path (optical axis 62) is not always necessary to be straight as shown in FIG. 1. The ion transport path may be bent to remove background ions.

(2) Operation

The operation of the mass spectrometer 1 of the first embodiment is next described. In the following description, it is assumed that ions created by the ion source 10 are positive ions. The created ions may also be negative ions, in which case the following principle can be applied if the voltage polarity is inverted.

The ions created by the ion source 10 pass through the opening in the electrode 12 and through the first differential pumping chamber 70 and enter the ion storage portion 20 from the entrance electrode 24.

The ion storage portion 20 once stores ions and then ejects them. Therefore, a pulsed voltage is applied to the exit electrode 26 of the storage portion 20 from the power supply 80. When the pulsed voltage applied to the exit electrode 26 is made higher than the axial voltage V1 on the ion guide 22, the exit electrode 26 is closed and ions are stored in the storage portion 20. On the other hand, when the pulsed voltage applied to the exit electrode 26 is made lower than the axial voltage V1 on the ion guide 22, the exit electrode 26 is opened and ions are ejected from the storage portion 20.

Because the ion source 10 is at the atmospheric pressure, a large amount of air enters the storage portion 20 from the opening in the entrance electrode 24. The kinetic energies of the ions present in the storage portion 20 are lowered by collision with the admitted air. The ions are bounced back by the potential barrier at the exit electrode 26 and return to the entrance electrode 24 during storage. The energies of the returning ions are lower than the energies assumed when they first pass through the entrance electrode 24. Therefore, if the voltage on the entrance electrode 24 is adjusted, it is possible that the ions coming from the upstream side will be passed and ions returning from the downstream side will be blocked off. Consequently, the storage efficiency of the ion storage portion 20 can be maintained at almost 100%.

Since the kinetic energies of the ions stored in the storage portion 20 are lowered by collision with air, the total energy of the ions ejected from the storage portion 20 is substantially equal to the potential energy created by the axial voltage V1 on the ion guide 22. Where the amount of air entering from the entrance electrode 24 is insufficient and the kinetic energies of the ions are not lowered sufficiently, the storage efficiency is improved by admitting gas from the gas inlet means 28.

Figure 2:
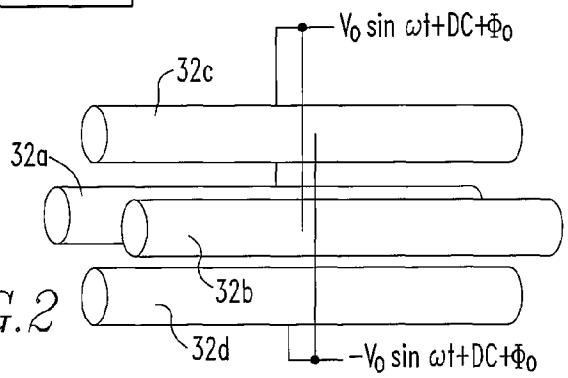
FIG. 2 is a perspective view of a quadrupole mass filter, illustrating voltages applied to the filter.

Ions ejected from the exit electrode 26 of the storage portion 20 are pulsed and pass through the first mass analyzer 30 in which the quadrupole mass filter 32 is mounted. Only ions with a desired mass-to-charge ratio are selected and passed. Selection voltages (RF voltage and DC voltage) and an axial voltage V2 for selecting ions according to each mass-to-charge ratio are supplied to the quadrupole mass filter 32 from the power supply 80. Specifically, as shown in FIG. 2, the quadrupole mass filter 32 consists of four electrode rods. A voltage of $V_0 \sin \omega t + DC + \phi_0$ is applied to two opposite electrodes 32*a* and 32*b* of the four electrode rods. A voltage of $-(V_0 \sin \omega t + DC) + \phi_0$ is applied to the remaining two opposite electrodes 32*c* and 32*d*. $V_0 \sin \omega t$ corresponds to the RF voltage. DC corresponds to the DC voltage. $\phi_0$ corresponds to the axial voltage V2. Only precursor ions selected according to the selection voltages (RF voltage and DC voltage) remain on the optical axis 62 and enter the collision cell 40. The precursor ions selected by the first mass analyzer 30 correspond to the first desired ions in the present invention. The precursor ions entering the collision cell 40 collide with the gas admitted from the gas inlet means 48 inside the cell 40. Where the collisional energy produced at this time is greater than the dissociation energy of the precursor ions, some of the precursor ions are fragmented with some probability into various product ions. The collisional energy is substantially equal to the potential energy difference due to the potential difference V1−V3 between the axial voltage on the ion guide 22 and the axial voltage on the ion guide 42. The product ions enter the second mass analyzer 50 together with unfragmented precursor ions.

The quadrupole mass filter 52 is mounted in the second mass analyzer 50 and selects and passes only ions of a desired mass-to-charge ratio according to the selection voltages. The selection voltages (RF voltage and DC voltage) and axial voltage V4 for selecting ions according to mass-to-charge ratio are supplied to the quadrupole mass filter 52 from the power supply 80. The selection voltages (RF voltage and DC voltage) and the axial voltage V4 applied to the quadrupole mass filter 52 are the same as those applied to the quadrupole mass filter 32 shown in FIG. 2. Ions (product ions or precursor ions) selected according to the selection voltages (RF voltage and DC voltage) remain on the optical axis 62 and enter the detector 60. The ions selected by the second mass analyzer 50 correspond to the second desired ions in the present invention.

Since the power supply 80 operates in the sequence specified from the personal computer (not shown) by the user under control of the controller 90, the first mass analyzer 30 and the second mass analyzer 50 can select ions with desired transitions in response to pulsed ions generated by the ion storage portion 20 at desired timing.

Generally, where ions are uniform in velocity, ions having larger masses have larger kinetic energies. The kinetic energies of ions passing through the first or second mass analyzer in the direction of the optical axis 62 can be controlled by the axial voltage V2 on the first mass analyzer or by the axial voltage V4 on the second mass analyzer. Especially, in the present embodiment, the axial voltage V2 or V4 is varied such that ions having larger masses have larger kinetic energies in the direction of the optical axis 62 as they pass through the first mass analyzer 30 or the second mass analyzer 50. The time taken for the ions to pass through the first mass analyzer 30 or the second mass analyzer 50 is kept substantially constant irrespective of mass-to-charge ratio.

The kinetic energies of the ions passing through the first mass analyzer 30 in the direction of the optical axis 62 are in proportion to the potential difference V1−V2 between the axial voltage on the ion guide 22 and the axial voltage on the quadrupole mass filter 32. The kinetic energies of the ions passing through the second mass analyzer 50 in the direction of the optical axis 62 are in proportion to the potential difference V3−V4 between the axial voltage on the ion guide 42 and the axial voltage on the quadrupole mass filter 52. Therefore, in order to make uniform the transit times of the selected ions, for example, through the first mass analyzer 30, the potential difference V1−V2 is increased with increasing mass-to-charge ratio of ion. Furthermore, when the axial voltage V1 is constant, the axial voltage V2 is reduced for ions having larger mass-to-charge ratios. Similarly, in order to make uniform the transit times of the selected ions through the second mass analyzer 50, the potential difference V3−V4 is increased for ions having larger mass-to-charge ratios. When the axial voltage V3 is constant, the axial voltage V4 is increased for ions having larger mass-to-charge ratios.

Theoretically, if it is assumed that the ions about to exit from the ion storage portion 20 or from the collision cell 40 have a kinetic energy of 0 and any velocity variation due to collision does not occur in the first mass analyzer 30 and in the second mass analyzer 50, the velocity v1 of ions having m/z passing through the first mass analyzer 30 is calculated from Eq. (1).

$$v1 = \sqrt{\frac{2ze(V1 - V2)}{m}} = \sqrt{\frac{2K1}{m}} \tag{1}$$

where m is the mass of an ion, z is a valence number, e is the elementary electric charge, and K1 is the kinetic energy of the ion traveling through the first mass analyzer 30 in the direction of the optical axis 62. It can be seen from Eq. (1) that in order to maintain constant the velocity v1, the kinetic energy K1 must be increased with increasing the mass m of the ion. When the velocity v1 is kept at a constant value A1, the axial voltage V2 is calculated from Eq. (2).

$$V2 = V1 - \frac{m}{2ze}A1^2 \quad (2)$$

That is, the flight velocities of ions passing through the first mass analyzer 30 in the direction of the optical axis are all kept at A1 irrespective of mass-to-charge ratio by varying the axial voltage V2 as given by Eq. (2) according to the mass-to-charge ratios (m/z) of the ions selected by the first mass analyzer 30. Accordingly, by using Eq. (2) in correlating the mass-to-charge ratio m/z and the axial voltage V2, the flight velocity of ions passing through the first mass analyzer 30 in the direction of the optical axis can be kept at the constant velocity A1.

Similarly, the velocity v2 of ions with a mass-to-charge ratio m/z passing through the second mass analyzer 50 is calculated from the following Eq. (3).

$$v2 = \sqrt{\frac{2ze(V3 - V4)}{m}} = \sqrt{\frac{2K2}{m}} \quad (3)$$

where K2 is the kinetic energy of the ions traveling through the second mass analyzer 50 in the direction of the optical axis 62. It can be seen from Eq. (3) that in order to maintain constant the velocity v2, the kinetic energy K2 must be increased with increasing the mass m of ion. When the velocity v2 is set to the constant value A2, the axial voltage V4 is calculated from the following Eq. (4).

$$V4 = V3 - \frac{m}{2ze}A2^2 \quad (4)$$

That is, if the axial voltage V4 is varied as given by Eq. (4) according to the mass-to-charge ratio m/z of ions selected by the second mass analyzer 50, the flight velocities of ions passing through the second mass analyzer 50 in the direction of the optical axis are all equal to A2 regardless of mass-to-charge ratio. Accordingly, by using Eq. (4) in correlating the mass-to-charge ratio m/z and the axial voltage V4, the flight velocities of ions passing through the second mass analyzer 50 in the direction of the optical axis can be kept at the constant velocity A2.

Accordingly, in the present embodiment, in order to substantially uniform the times taken for ions to pass through the first mass analyzer 30 regardless of mass-to-charge ratio, the controller 90 modifies the axial voltage V2 supplied from the power supply 80 according to Eq. (2) and according to the mass-to-charge ratios m/z of the ions selected by the first mass analyzer 30. Similarly, to make substantially uniform the times taken to pass through the second mass analyzer 50 regardless of the mass-to-charge ratios of ions, the controller 90 varies the axial voltage V4 supplied from the power supply 80 according to Eq. (4) and according to the mass-to-charge ratio m/z of the ions selected by the second mass analyzer 50.

Alternatively, a table indicating the correspondence between the mass-to-charge ratios of selected ions and the axial voltages may be created and stored in a storage portion (not shown), and the controller 90 may refer to the table and vary the axial voltages V2 and V4 according to the mass-to-charge ratio of each selected ion. For example, plural reference samples are ionized. The axial voltages V2 and V4 are so adjusted that all the flight times taken for plural ions having known mass-to-charge ratios to pass through the first mass analyzer 30 and the second mass analyzer 50 have desired values. A table indicating the relationships of mass-to-charge ratios to the axial voltages V2 and V4 can be created over the whole mass range of the instrument by interpolating the obtained relationships of the mass-to-charge ratios to the axial voltages V2 and V4.

Still alternatively, a mathematical formula approximating the correlations of the mass-to-charge ratios and the axial voltages indicated by the table may be found. The controller 90 may vary the axial voltages V2 and V4 according to the formula and according to each mass-to-charge ratio of the selected ions.

Figure 3:
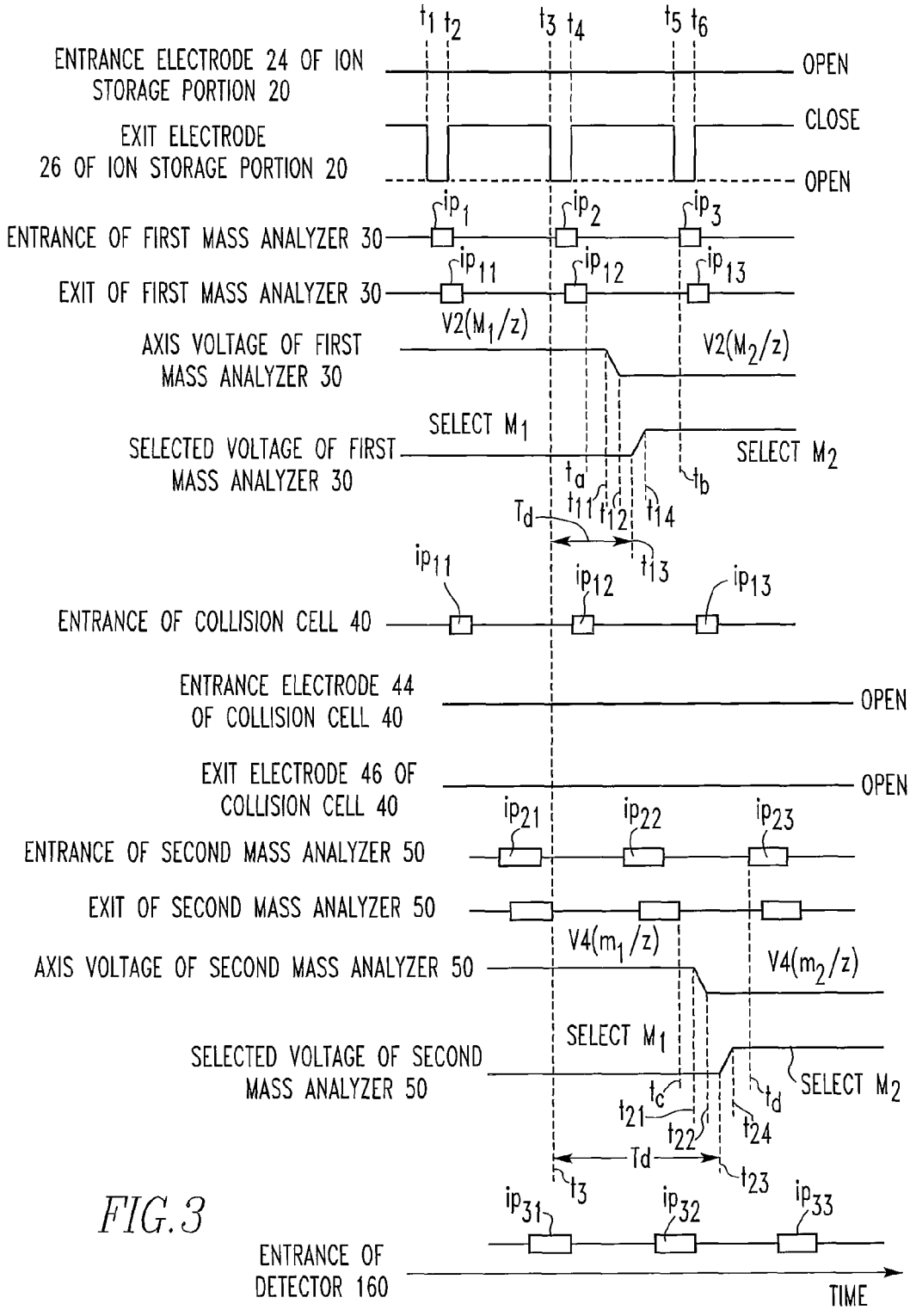
FIG. 3 is a diagram illustrating one example of sequence of operations performed by the mass spectrometer according to the first embodiment of the invention.

FIG. 3 is a timing chart showing one example of sequence of operations performed by the mass spectrometer 1. In this sequence, the transition is varied from a transition TR1 where the first mass analyzer 30 and the second mass analyzer 50 select ions having mass-to-charge ratios of $M_1/z$ and $m_1/z$, respectively, to a transition TR2 where the first mass analyzer 30 and the second mass analyzer 50 select ions having mass-to-charge ratios of $M_2/z$ and $m_2/z$, respectively.

As shown in FIG. 3, a constant voltage lower than the voltage on the electrode 12 is applied to the entrance electrode 22 of the ion storage portion 20. The entrance of the storage portion 20 is always open. Therefore, almost 100% of the ions created by the ion source 10 are passed into the storage portion 20 and stored there.

Two different voltages are periodically applied to the exit electrode 26 of the ion storage portion 20. When the voltage on the exit electrode 26 is higher than the axial voltage on the ion guide 22, the exit of the storage portion 20 is closed and ions are stored. On the other hand, where the voltage on the exit electrode 26 is lower than the axial voltage on the ion guide 22, the exit of the storage portion 20 is opened and ions are ejected. That is, since the voltage on the exit electrode 26 of the storage portion 20 is switched periodically, the storage portion 20 performs a storage operation and an ejection operation alternately and repeatedly.

More specifically, ions are stored in the ion storage portion 20 until instant $t_1$. A pulsed ion $ip_1$ is ejected from the storage portion 20 during the period from instant $t_1$ to instant $t_2$. Ions are stored in the storage portion 20 during the period from instant $t_2$ to instant $t_3$. A pulsed ion $ip_2$ is ejected from the storage portion 20 during the period from instant $t_3$ to instant $t_4$. Ions are stored in the storage portion 20 during the period from instant $t_4$ to instant $t_5$. A pulsed ion $ip_3$ is ejected from the storage portion 20 during the period from instant $t_5$ to instant $t_6$. These pulsed ions $ip_1$, $ip_2$, and $ip_3$ enter the first mass analyzer 30 in turn.

In the first mass analyzer 30, the selection voltages (RF voltage and DC voltage) are switched during the period from instant $t_{13}$ to instant $t_{14}$. Ions with a mass-charge-ratio of $M_1/z$ are selected until instant $t_{13}$. Ions with a mass-to-charge ratio of $M_2/z$ are selected from instant $t_{14}$. Consequently, while passing through the first mass analyzer 30, the pulsed ions $ip_1$ and $ip_2$ become pulsed ions $ip_{11}$ and $ip_{12}$, respectively, with a mass-to-charge ratio of $M_1/z$. The pulsed ion $ip_3$ becomes a pulsed ion $ip_{13}$ with a mass-to-charge ratio of $M_2/z$ while passing through the first mass analyzer 30. The duration of the pulsed ions $ip_{11}$, $ip_{12}$, and $ip_{13}$ is substantially the same as the period for which the exit electrode 26 of the storage portion 20 is opened. The pulsed ions $ip_{11}$, $ip_{12}$, and $ip_{13}$ enter the collision cell 40.

A variation time from instant $t_{13}$ to instant $t_{14}$ is a transient time taken until the selection voltages (RF voltage and DC voltage) stabilize when the selected ions are switched from precursor ions with $M_1/z$ to precursor ions with $M_2/z$, i.e., when the transition is switched from TR1 to TR2. Pulsed ions passing into the first mass analyzer during the variation time from instant $t_{13}$ to $t_{14}$ do not reach the detector 60 or reach it but the transition cannot be identified and so the signal must be discarded. This leads to a decrease in the detection sensitivity. Accordingly, in order to prevent ions from entering the first mass analyzer 30 during the variation time from $t_{13}$ to $t_{14}$, the instant $t_{13}$ is set later than an instant $t_a$ at which the last pulsed ion $ip_{12}$ of the transition TR1 finishes passing through the first mass analyzer 30. Furthermore, the instant $t_{14}$ is set earlier than an instant $t_b$ at which the first pulsed ion $ip_3$ of the transition TR2 begins to pass through the first mass analyzer 30.

The axial voltage V2 on the first mass analyzer 30 is varied from V2 ($M_1/z$) to V2 ($M_2/z$) in step with variation of the selection voltages (RF voltage and DC voltage). An instant $t_{11}$ at which the axial voltage V2 is started to be varied is set later than the instant $t_a$ at which the last pulsed ion $ip_{12}$ of the transition TR1 finishes passing through the first mass analyzer 30. An instant $t_{12}$ at which the variation ends is set earlier than the instant $t_b$ at which the first pulsed ion $ip_3$ of the transition TR2 starts to enter the first mass analyzer 30.

As described previously, in the present embodiment, the axial voltage V2 is changed based on Eq. (2) or a previously created table or mathematical formula and according to the mass-to-charge ratio of selected ions such that the times taken for the selected ions to pass through the first mass analyzer 30 are substantially the same irrespective of the mass-to-charge ratio of the selected ions. In consequence, the period between the instant at which the exit of the ion storage portion 20 begins to open and the instant at which the pulsed ion finishes passing through the first mass analyzer 30 is substantially constant irrespectively of ions selected by the first mass analyzer 30. Accordingly, the period between the instant $t_3$ at which the last pulsed ion of the transition TR1 is ejected from the storage portion 20 and the instant $t_a$ at which the ion finishes passing through the first mass analyzer 30 is nearly constant regardless of ions selected by the first mass analyzer 30. Hence, the period $Td_1$ between the instant $t_3$ at which the last pulsed ion of the transition TR1 is ejected from the storage portion 20 and the instant $t_{13}$ at which the selection voltages (RF voltage and DC voltage) on the first mass analyzer 30 are started to be changed can be made substantially constant irrespective of ions selected by the first mass analyzer 30.

A constant voltage lower than the voltage used when the exit electrode 26 of the ion storage portion 20 is opened is applied to the entrance electrode 44 of the collision cell 40. The entrance of the collision cell 40 is open at all times. Therefore, almost 100% of ions passed through the first mass analyzer 30 enter the collision cell 40. A constant voltage lower than the voltage on the entrance electrode 44 is applied to the exit electrode 46 of the collision cell 40. The exit of the collision cell 40 is always opened. The pulsed ions $ip_{11}$, $ip_{12}$, and $ip_{13}$ are partially fragmented into product ions while passing through the collision cell 40. At the exit of the collision cell 40, the ions become pulsed ions $ip_{21}$, $ip_{22}$, and $ip_{23}$ including the product ions. These pulsed ions $ip_{21}$, $ip_{22}$, and $ip_{23}$ enter the second mass analyzer 50 in turn.

In the second mass analyzer 50, the selection voltages (RF voltage and DC voltage) are switched during the period from instant $t_{23}$ to $t_{24}$. Ions with a mass-to-charge ratio of $m_1/z$ are selected until the instant $t_{23}$. Ions with a mass-to-charge ratio of $m_2/z$ are selected from the instant $t_{24}$. Consequently, while passing through the second mass analyzer 50, the pulsed ions $ip_{21}$ and $ip_{22}$ become pulsed ions $ip_{31}$ and $ip_{32}$, respectively, with a mass-to-charge ratio of $m_1/z$. The pulsed ion $ip_{23}$ becomes a pulsed ion $ip_{33}$ with a mass-to-charge ratio of $m_2/z$ while passing through the second mass analyzer 50. Individual product ions produced in the collision cell 40 are different in location, instant of time, and velocity and so the duration of the pulsed ions $ip_m$, $ip_{32}$, and $ip_{33}$ becomes longer than the period for which the exit electrode 26 of the storage portion 20 is opened. The pulsed ions $ip_{31}$, $ip_{32}$, and $ip_{33}$ passed through the second mass analyzer 50 enter the detector 60.

Another variation time from the instant $t_{23}$ to instant $t_{24}$ is a transient time taken until the selection voltages (RF voltage and DC voltage) stabilize when selected ions are varied from ions with a mass-to-charge ratio of $m_1/z$ to ions with a mass-to-charge ratio of $m_2/z$, i.e., the transition is varied from TR1 to TR2. Pulsed ions entering the second mass analyzer during the variation time of $t_{23}$-$t_{24}$ do not reach the detector 60 or reach it but the transition cannot be identified and so the signal must be discarded. This leads to a decrease in the detection sensitivity. Accordingly, in order to prevent ions from entering the second mass analyzer 50 during the variation time of $t_{23}$-$t_{24}$, the instant $t_{23}$ is set later than an instant $t_c$ at which the last pulsed ion $ip_{32}$ of the transition TR1 finishes passing through the second mass analyzer 50. The instant $t_{24}$ is set earlier than an instant $t_d$ at which the first pulsed ion $ip_{23}$ of the transition TR2 begins to pass through the second mass analyzer 50.

The axial voltage V4 on the second mass analyzer 50 is varied from V4 ($m_1/z$) to V4 ($m_2/z$) in step with variation of the selection voltages (RF voltage and DC voltage). An instant $t_{21}$ at which the axial voltage V4 starts to be varied is set later than the instant $t_c$ at which the last pulsed ion $ip_{32}$ of the transition TR1 finishes passing through the second mass analyzer 50. An instant $t_{22}$ at which the variation ends is set earlier than the instant $t_d$ at which the first pulsed ion $ip_{23}$ of the transition TR2 begins to enter the second mass analyzer 50.

As described previously, in the present embodiment, the axial voltage V4 is changed based on Eq. (4) or a previously created table or mathematical formula and according to the mass-to-charge ratio of selected ions such that the times taken for the selected ions to pass through the second mass analyzer 50 are substantially the same irrespective of the mass-to-charge ratio of the selected ions. Also, the times taken for the selected ions to pass through the first mass analyzer 30 are substantially the same irrespective of the mass-to-charge ratio of the selected ions. In consequence, the period between the instant at which the exit of the ion storage portion 20 begins to be opened and the instant at which the pulsed ion finishes passing through the second mass analyzer 50 is substantially constant irrespectively of ions selected by the second mass analyzer 50. Accordingly, the period between the instant $t_3$ at which the last pulsed ion of the transition TR1 is ejected from the storage portion 20 and the instant $t_c$ at which the ion finishes passing through the second mass analyzer 50 is nearly constant regardless of ions selected by the second mass analyzer 50. Hence, the period $Td_2$ between the instant $t_3$ at which the last pulsed ion of the transition TR1 is ejected from the storage portion 20 and the instant $t_{23}$ at which the selection voltages (RF voltage and DC voltage) on the second mass analyzer 50 are started to be changed can be made substantially constant irrespective of ions selected by the second mass analyzer 50.

According to the mass spectrometer of the first embodiment described so far, the times taken for selected ions to pass through the first mass analyzer 30 can be made substantially constant irrespective of mass-to-charge ratio by varying the axial voltage V2 such that the kinetic energies of the selected ions in the direction of the optical axis 62 increase with increasing the mass of the ions selected by the first mass analyzer 30 as they pass through the first mass analyzer 30. Consequently, the period $Td_1$ between the instant at which the last pulsed ion prior to variation of the transition is ejected from the storage portion 20 and the instant at which the selection voltages on the first mass analyzer 30 are varied are almost constant and, therefore, the timing at which the ions are selected by the first mass analyzer 30 are varied can be controlled with greater ease.

Similarly, according to the mass spectrometer of the first embodiment, the times taken for the selected ions to pass through the second mass analyzer 50 can be made substantially constant irrespective of mass-to-charge ratio by varying the axial voltage V4 such that the kinetic energies of the selected ions in the direction of the optical axis 62 increase with increasing the mass of the ions selected by the second mass analyzer 50 as they pass through the second mass analyzer 50. Consequently, the period $Td_2$ between the instant at which the last pulsed ion prior to variation of the transition is ejected from the storage portion 20 and the instant at which the selection voltages on the second mass analyzer 50 are varied is made substantially constant and, therefore, the timing at which ions selected by the second mass analyzer 50 are varied can be controlled with greater ease.

2. Second Embodiment

(1) Configuration

Generally, precursor ions fragment into product ions with some probability. Therefore, in the mass spectrometer 1 of the above-described first embodiment, pulsed ions are spread widthwise within the collision cell 40. For example, in the example of FIG. 3, the pulsed ion $ip_{11}$ impinging on the collision cell 40 becomes the wider pulsed ion $ip_{21}$ when exiting from the cell 40. As a result, the pulsed ion $ip_{31}$ entering the detector 60 is also spread widthwise. Generally, as the width of a pulsed ion entering the detector 60 increases, more noise is contained in the pulsed ion. This causes a deterioration of the detection sensitivity for ion intensity.

Accordingly, in a mass spectrometer according to the second embodiment, the width of pulsed ions entering the detector 60 is reduced by causing ions to be once stored in the collision cell 40, as well as in the storage portion 20, and then ejected. Therefore, the power supply 80 applies desired voltages to the electrode 44, ion guide 42, and electrode 46 under control of the controller 90 such that the collision cell 40 performs an operation for storing product ions and an operation for ejecting the ions repeatedly.

Where each of the ion storage portion 20 and the collision cell 40 ejects only one pulsed ion for each transition, the integrated intensity of pulsed ions hitting the detector 60 is the ion intensity of the transition. If the period at which the exit electrode 26 of the storage portion 20 begins to open is made constant and the period at which the exit electrode 46 of the collision cell 40 begins to open is made constant, the ion intensity of each transition is in proportion to the amount of precursor ions produced by the ion source 10 during a given period, i.e., the opening period. As a result, individual transitions can be compared in terms of intensity.

Since the mass spectrometer of the second embodiment is similar in configuration to the mass spectrometer of the first embodiment shown in FIG. 1, its illustration and description are omitted.

(2) Operation

The operation of the mass spectrometer according to the second embodiment is next described. In the following description, it is assumed that ions created by the ion source 10 are positive ions. The created ions may also be negative ions, in which case the following principle can be applied if the voltage polarity is inverted.

Since the ion source 10, ion storage portion 20, first mass analyzer 30, second mass analyzer 50, and detector 60 are identical in operation to their counterparts of the mass spectrometer of the first embodiment, their description is omitted.

The present embodiment is characterized in that ions are once stored in the collision cell 40 as well as in the ion storage portion 20 and then ejected. To repeat storage and ejection of ions by the collision cell 40, pulsed voltages are applied to the exit electrode 46 from the power supply 80. When the pulsed voltage V3 applied to the exit electrode 46 is made higher than the axial voltage on the ion guide 42, the exit electrode 46 is closed. Ions are stored in the collision cell 40. On the other hand, when the pulsed voltage applied to the exit electrode 46 is made lower than the axial voltage V3 on the ion guide 42, the exit electrode 46 is opened. Ions are ejected from the collision cell 40. A collision gas such as a rare gas is admitted into the collision cell 40 from the gas inlet means 48. The collision gas has the effect of creating product ions by fragmenting precursor ions. In addition, it has the effect of lowering the kinetic energies of ions within the collision cell 40 by collision. Therefore, ions which return to the entrance electrode 44 after being bounced back by the potential barrier at the exit electrode 46 during ion storage become lower in energy than when they first passed through the entrance electrode 44. Consequently, ions from the upstream side can be passed and ions returning from the downstream side can be blocked off by adjusting the voltage on the entrance electrode 44. Thus, the storage efficiency of the collision cell 40 can be maintained at about 100%.

During ion storage, precursor ions and product ions reciprocate between the entrance electrode 44 and the exit electrode 46 while repeatedly colliding with the collision gas. As a result, their kinetic energies are almost all lost. In consequence, the total energy of ions ejected from the collision cell 40 becomes substantially equal to the potential energy owing to the axial voltage V3 on the ion guide 42.

In the present embodiment, the axial voltages V2 and V4 are so varied that the ions having larger masses have larger kinetic energies in the direction of the optical axis 62 as they pass through the first mass analyzer 30 or the second mass analyzer 50 such that the times taken for the ions to pass through the first mass analyzer 30 or the second mass analyzer 50 are substantially the same irrespective of mass-to-charge ratio, in the same way as in the first embodiment. Therefore, in the second embodiment, too, the axial voltage V2 is modified according to the mass-to-charge ratio of the selected ions and based on Eq. (2) or a previously created table or mathematical formula. The axial voltage V4 is varied according to the mass-to-charge ratio of the selected ions and based on Eq. (4) or a previously created table or mathematical formula.

Figure 4:
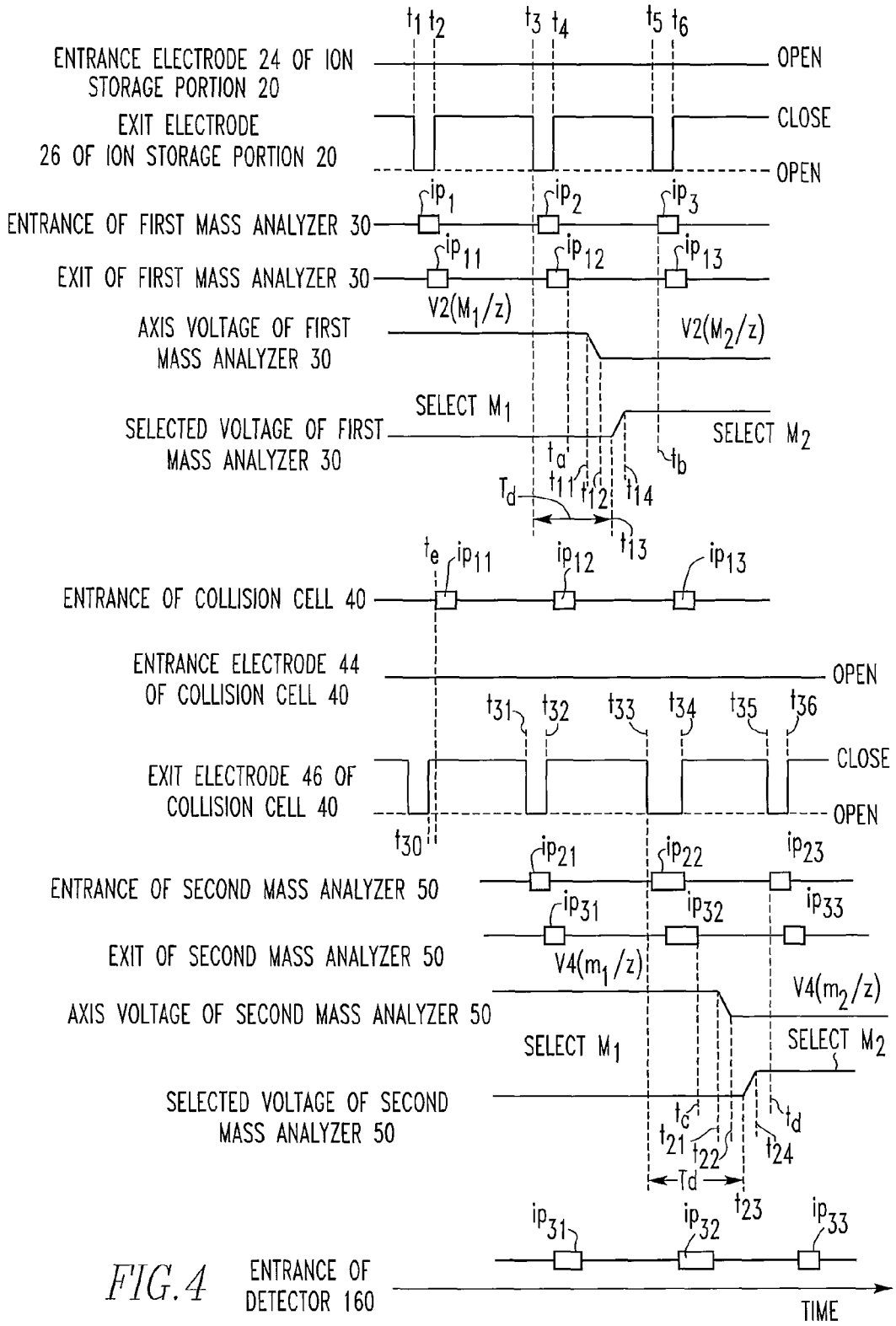
FIG. 4 is a diagram illustrating one example of sequence of operations performed by a mass spectrometer according to a second embodiment of the invention.

FIG. 4 is a timing chart illustrating one example of sequence of operations performed by the mass spectrometer 1 according to the second embodiment, and depicts the case where the transition is varied from TR1 in which ions with a mass-to-charge ratio of $M_1/z$ and ions with a mass-to-charge ratio of $m_1/z$ are selected by the first mass analyzer 30 and the second mass analyzer 50, respectively, to TR2 in which ions with a mass-to-charge ratio of $M_2/z$ and ions with a mass-to-charge ratio of $m_2/z$ are selected by the first mass analyzer 30 and the second mass analyzer 50, respectively, in the same way as in FIG. 3.

As shown in FIG. 4, a constant voltage lower than the voltage on the electrode 12 is applied to the entrance electrode 22 of the storage portion 20 such that the entrance of the storage portion 20 is opened at all times. Two different voltages are periodically applied to the exit electrode 26 of the storage portion 20. As the voltage on the exit electrode 26 of the storage portion 20 is switched periodically, the storage portion 20 repeats the storage operation and the ejection operation alternately. Consequently, the pulsed ions $ip_1$, $ip_2$, and $ip_3$ are ejected from the storage portion 20 and enter the first mass analyzer 30 in turn.

In the first mass analyzer 30, the selection voltages (RF voltage and DC voltage) are switched during the period from the instant $t_{13}$ to instant $t_{14}$. Ions with a mass-charge-ratio of $M_1/z$ are selected until the instant $t_{13}$. Ions with a mass-to-charge ratio of $M_2/z$ are selected from the instant $t_{14}$. To prevent ions from entering the first mass analyzer 30 during the variation time from instant $t_{13}$ to instant $t_{14}$, the instant $t_{13}$ is set later than the instant $t_a$ at which the last pulsed ion $ip_{12}$ of the transition TR1 finishes passing through the first mass analyzer 30. Furthermore, the instant $t_{14}$ is set earlier than the instant $t_b$ at which the first pulsed ion $ip_3$ of the transition TR2 begins to pass through the first mass analyzer 30.

The axial voltage V2 on the first mass analyzer 30 is varied from V2 ($M_1/z$) to V2 ($M_2/z$) in step with variation of the selection voltages (RF voltage and DC voltage). The instant $t_{11}$ at which the axial voltage V2 is started to be varied is set later than the instant $t_a$ at which the last pulsed ion $ip_{12}$ of the transition TR1 finishes passing through the first mass analyzer 30. The instant $t_{12}$ at which the variation ends is set earlier than the instant $t_b$ at which the first pulsed ion $ip_3$ of the transition TR2 starts to enter the first mass analyzer 30.

In the present embodiment, too, the axial voltage V2 is changed based on Eq. (2) or a previously created table or mathematical formula and according to the mass-to-charge ratio of selected ions such that the times taken for the selected ions to pass through the first mass analyzer 30 are substantially the same irrespective of the mass-to-charge ratio of the selected ions. In consequence, the period between the instant at which the exit of the ion storage portion 20 begins to be opened and the instant at which the pulsed ion finishes passing through the first mass analyzer 30 is substantially constant irrespectively of ions selected by the first mass analyzer 30. Accordingly, the period between the instant $t_3$ at which the last pulsed ion of the transition TR1 is ejected from the storage portion 20 and the instant $t_a$ at which the ion finishes passing through the first mass analyzer 30 is nearly constant regardless of ions selected by the first mass analyzer 30. Hence, the period $Td_1$ between the instant $t_3$ at which the last pulsed ion of the transition TR1 is ejected from the storage portion 20 and the instant $t_{13}$ at which the selection voltages (RF voltage and DC voltage) on the first mass analyzer 30 are started to be changed can be made substantially constant irrespective of ions selected by the first mass analyzer 30.

The pulsed ions $ip_{11}$, $ip_{12}$, and $ip_{13}$ arising from the precursor ions selected by the first mass analyzer 30 enter the collision cell 40. A constant voltage lower than the voltage for opening the exit electrode 26 of the storage portion 20 is applied to the entrance electrode 44 of the cell 40. The entrance of the collision cell 40 is always open. Therefore, almost 100% of the precursor ions passed through the first mass analyzer 30 enter the collision cell 40. Two different voltages are periodically applied to the exit electrode 46 of the collision cell 40. When the voltage on the exit electrode 46 is higher than the axial voltage on the ion guide 42, the exit of the collision cell 40 is closed and ions are stored. On the other hand, when the voltage on the exit electrode 46 is lower than the axial voltage on the ion guide 42, the exit of the collision cell 40 is opened and product ions and unfragmented precursor ions are expelled. That is, the collision cell 40 repeatedly and alternately performs the storing operation and the expelling operation because the voltage on the exit electrode 46 of the collision cell 40 is periodically switched.

In particular, ions are stored in the collision cell 40 during the period from instant $t_{30}$ to instant $t_{31}$. The pulsed ion $ip_{21}$ is ejected from the collision cell 40 during the period from instant $t_{31}$ to instant $t_{32}$. Ions are stored in the collision cell 40 during the period from instant $t_{32}$ to instant $t_{33}$. The pulsed ion $ip_{22}$ is ejected from the collision cell 40 during the period from instant $t_{33}$ to instant $t_{34}$. Ions are stored in the collision cell 40 during the period from instant $t_{34}$ to instant $t_{35}$. The pulsed ion $ip_{23}$ is ejected from the collision cell 40 during the period from instant $t_{35}$ to instant $t_{36}$.

To enhance the efficiency at which precursor ions are fragmented in the collision cell 40, it is advantageous to increase the storage time. For this purpose, the instant at which pulsed ions begin to enter the collision cell 40 may be placed immediately after the exit electrode 46 is closed. For example, it is better that the instant $t_e$ at which the pulsed ion $ip_{11}$ begins to enter the collision cell 40 be placed immediately after the instant $t_{30}$ at which the exit electrode 46 is closed for storing the pulsed ion. Where it is difficult to make this setting, the exit electrode 46 is closed at least while pulsed ions are entering the collision cell 40 such that the ions can be stored.

Where the ion selected by the first mass analyzer 30 is varied after a modification of the transition, all the ions in the collision cell 40 are ejected before the pulsed ions of the next transition enter the collision cell 40. Consequently, all the product ions in the collision cell 40 arise from the same precursor ions, thus suppressing interference (crosstalk) between the transitions. For example, when the transition is varied from TR1 to TR2, ions selected by the first mass analyzer 30 vary. Therefore, the period $t_{34}$-$t_{33}$ for which the collision cell 40 is opened to eject the last pulsed ion $ip_{22}$ of the transition TR1 from the cell 40 needs to be long enough to eject all the ions in the cell 40. However, in a case where the pulsed ion ejected from the collision cell 40 is not the last pulsed ion of the transition or where the pulsed ion is the last pulsed ion but the ion selected by the first mass analyzer 30 does not vary in the next transition, it is not necessary to eject all the ions in the cell 40 by the operation for opening the exit electrode 46. For example, the pulsed ion $ip_{21}$ is not the last pulsed ion in the transition TR1. When they are ejected, it is not necessary to eject all the ions in the collision cell 40. In summary, the period of $t_{34}$-$t_{33}$ for which the last pulsed ion $ip_{22}$ in the transition TR1 is ejected from the cell 40 is set longer than the period $t_{32}$-$t_{31}$ for which other pulsed ions of the transition TR1 (such as pulsed ion $ip_{21}$) are ejected from the cell 40.

The pulsed ions $ip_{21}$, $ip_{22}$, and $ip_{23}$ ejected from the collision cell 40 enter the second mass analyzer 50 in turn. The duration of the pulsed ions $ip_{21}$, $ip_{22}$, and $ip_{23}$ is substantially the same as the time for which the exit electrode 46 of the cell 40 is opened. In the second mass analyzer 50, the selection voltages (RF voltage and DC voltage) are switched during the period from instant $t_{23}$ to instant $t_{24}$. Ions with a mass-to-charge ratio of $m_1/z$ are selected until the instant $t_{23}$. Ions with a mass-to-charge ratio of $m_2/z$ are selected from the instant $t_{24}$. The pulsed ions $ip_{31}$, $ip_{32}$, and $ip_{33}$ passed through the second mass analyzer 50 enter the detector 60.

To prevent ions from entering the second mass analyzer 50 during a variation time from instant $t_{23}$ to instant $t_{24}$, the instant $t_{23}$ is set later than the instant $t_c$ at which the last pulsed ion $ip_{32}$ of the transition TR1 finishes passing through the second mass analyzer 50. The instant $t_{24}$ is set earlier than the instant $t_d$ at which the first pulsed ion $ip_{23}$ of the transition TR2 begins to pass through the second mass analyzer 50.

The axial voltage V4 on the second mass analyzer 50 is varied from V4 ($m_1/z$) to V4 ($m_2/z$) in step with variation of the selection voltages (RF voltage and DC voltage). The instant $t_{21}$ at which the axial voltage V4 begins to be varied is set later than the instant $t_c$ at which the last pulsed ion $ip_{32}$ of the transition TR1 finishes passing through the second mass analyzer 50. The instant $t_{22}$ at which the variation ends is set earlier than the instant $t_d$ at which the first pulsed ion $ip_{23}$ of the transition TR2 begins to enter the second mass analyzer 50.

In the present embodiment, too, the axial voltage V4 is changed based on Eq. (4) or a previously created table or mathematical formula and according to the mass-to-charge ratio of selected ions such that the times taken for the selected ions to pass through the second mass analyzer 50 are substantially the same irrespective of the mass-to-charge ratio of the selected ions. In consequence, the period between the instant at which the exit of the collision cell 40 begins to open and the instant at which the pulsed ion finishes passing through the second mass analyzer 50 is substantially constant irrespectively of ions selected by the second mass analyzer 50. Accordingly, the period between the instant $t_{33}$ at which the last pulsed ion of the transition TR1 is ejected from the cell 40 and the instant $t_c$ at which the ion finishes passing through the second mass analyzer 50 is nearly constant regardless of ions selected by the second mass analyzer 50. Hence, the period $Td_2$ between the instant $t_{33}$ at which the last pulsed ion of the transition TR1 is ejected from the cell 40 and the instant $t_{23}$ at which the selection voltages (RF voltage and DC voltage) on the second mass analyzer 50 are started to be changed can be made substantially constant irrespective of ions selected by the second mass analyzer 50.

According to the mass spectrometer of the second embodiment described so far, the times taken for selected ions to pass through the first mass analyzer 30 can be made substantially constant irrespective of mass-to-charge ratio by varying the axial voltage V2 such that those of the ions selected by the first mass analyzer 30 which have larger masses have larger kinetic energies in the direction of the optical axis 62 as they pass through the first mass analyzer 30. Consequently, the period $Td_1$ between the instant at which the last pulsed ion prior to modification of the transition is ejected from the storage portion 20 and the instant at which the selection voltages on the first mass analyzer 30 are varied is substantially constant. Hence, the timing at which the ions selected by the first mass analyzer 30 are varied can be controlled easily.

Similarly, according to the mass spectrometer 1 of the second embodiment, the times taken for selected ions to pass through the second mass analyzer 50 can be made substantially uniform regardless of mass-to-charge ratio by varying the axial voltage V4 in such a way that those of the ions selected by the second mass analyzer 50 which have larger masses exhibit larger kinetic energies in the direction of the optical axis 62 as they pass through the second mass analyzer 50. As a result, the period $Td_2$ between the instant at which the last pulsed ion prior to modification of the transition is ejected from the collision cell 40 and the instant at which the selection voltages on the second mass analyzer 50 are varied are made substantially constant. In consequence, the timing at which ions selected by the second mass analyzer 50 are varied can be controlled easily.

Furthermore, according to the present embodiment, ions are stored in the collision cell 40 and pulsed ions are ejected. Consequently, widthwise spread of pulsed ions entering the detector 60 can be suppressed. Thus, the detection sensitivity can be improved further.

3. Modified Embodiments

The present embodiment can be variously modified without departing from the essential features of the present invention.

Modified Embodiment 1

Figure 5:
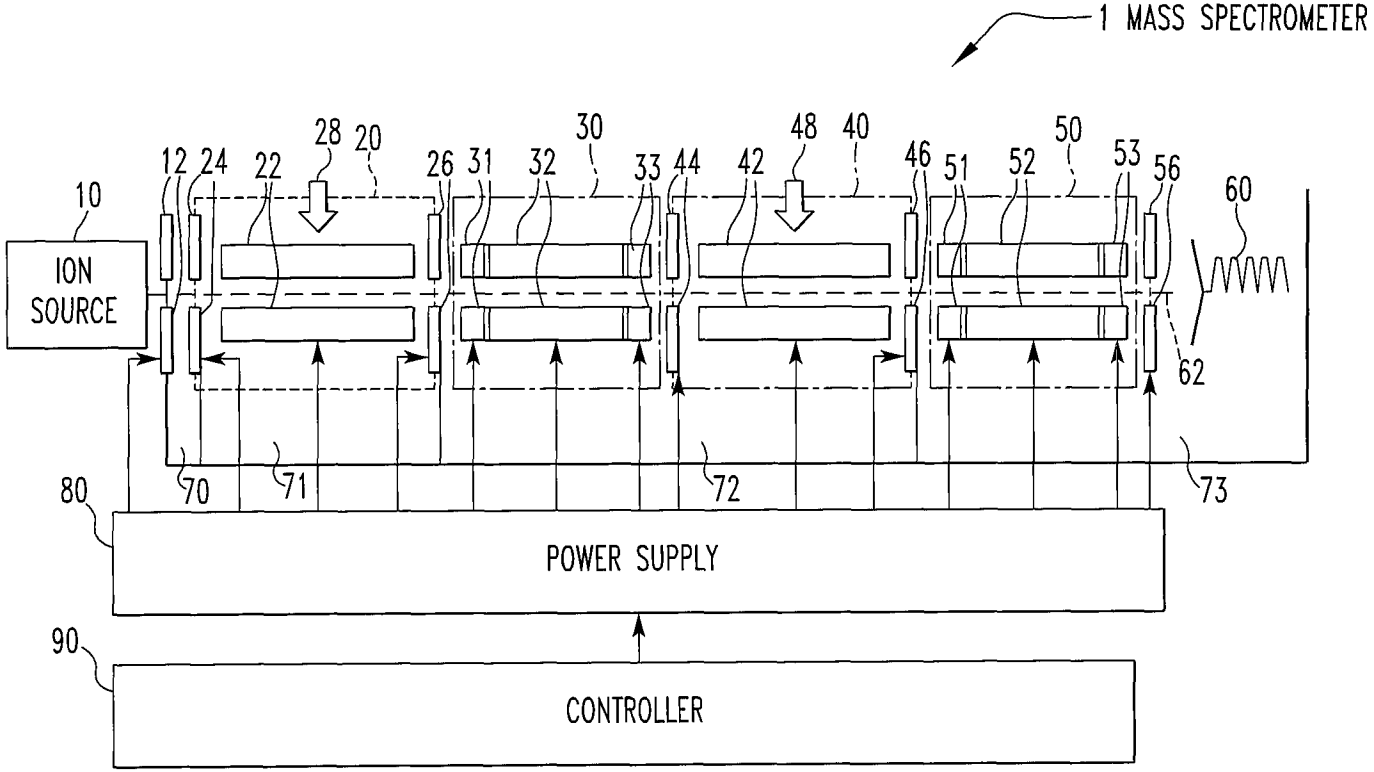
FIG. 5 is a diagram showing the configuration of a mass spectrometer according to modified first embodiment.

A pre-filter and a post-filter can be mounted respectively before and after the quadrupole mass filter of the first mass analyzer. Also, a pre-filter and a post-filter can be mounted respectively before and after the quadrupole mass filter of the second mass analyzer. An example of the configuration of this mass spectrometer is shown in FIG. 5. Those components of the instrument of FIG. 5 which are identical in configuration to their counterparts of the instrument of FIG. 1 are indicated by the same reference numerals as in FIG. 1 and their description is omitted.

Ions ejected from the exit electrode 26 of the ion storage portion 20 are pulsed and pass through the first mass analyzer 30, where the quadrupole mass filter 32 is mounted. A pre-filter 31 and a post-filter 33 are placed respectively before and after the mass filter 32 to select and pass only ions of a desired mass-to-charge ratio. The pre-filter 31 and post-filter 33 serve as ion guides and are located respectively before and after the quadrupole mass filter 32 to thereby enhance the ion transmission efficiency. Selection voltages (RF voltage and DC voltage) and the axial voltage v2 are supplied to the quadrupole mass filter 32 to select ions according to mass-to-charge ratio from the power supply 80. Desired axial voltages are supplied to the pre-filter 31 and post-filter 33 also from the power supply 80.

Figure 6:
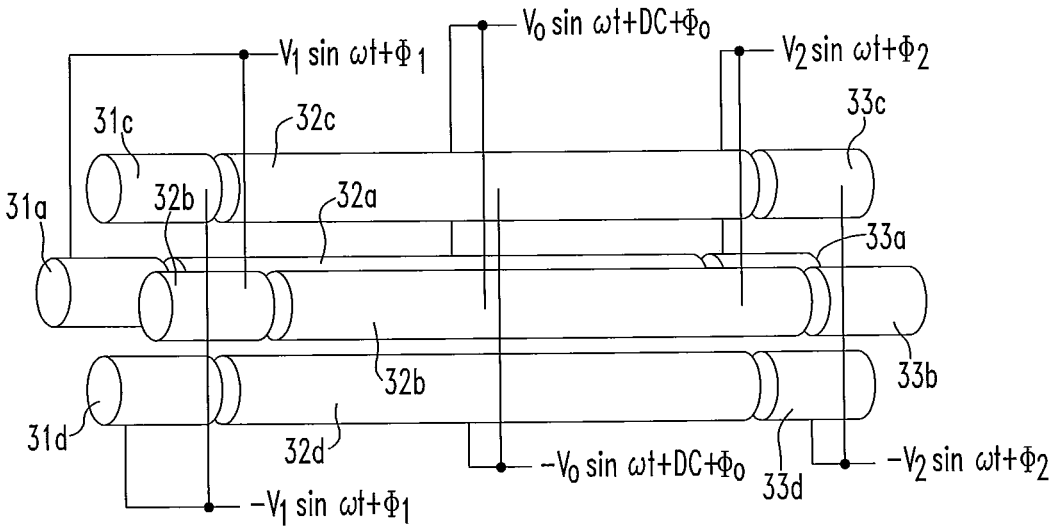
FIG. 6 is a perspective view of a pre-filter, a quadrupole mass filter, and a post-filter, illustrating voltages applied to them.

More specifically, as shown in FIG. 6, a voltage of $V_0 \sin \omega t+DC+\phi_0$ is applied to two opposite electrodes 32*a* and 32*b* of the electrode rods constituting the quadrupole mass filter 32. A voltage of $-(V_0 \sin \omega t+DC)+\phi_0$ is applied to the remaining two opposite electrodes 32*c* and 32*d*. A voltage of $V_1 \sin \omega t+\phi_1$ is applied to two opposite electrodes 31*a* and 31*b* of four electrode rods constituting the pre-filter 31. A voltage of $-V_1 \sin \omega t+\phi_1$ is applied to the remaining two opposite electrodes 31*c* and 31*d*. A voltage of $V_2 \sin \omega t+\phi_2$ is applied to two opposite electrodes 33*a* and 33*b* of four electrode rods constituting the post-filter 33. A voltage of $-V_2 \sin \omega t+\phi_2$ is applied to the remaining two opposite electrodes 33*c* and 33*d*. The RF voltage and DC voltage on the first mass analyzer 30 are $V_0 \sin \omega t$ and DC, respectively. The axial voltage V2 is obtained by averaging the voltages $\phi_0$, $\phi_1$, and $\phi_2$ with weighting with the lengths of the quadrupole mass filter 32, pre-filter 31, and post-filter 33. The electrodes 31*a* and 32*a* may be connected together via a capacitor. Similarly, the electrodes 31*b* and 32*b*, the electrodes 31*c* and 32*c*, and the electrodes 31*d* and 32*d* may be connected together via respective capacitors. The axial voltage $\phi_1$ may be applied to all of the electrodes 31*a*, 31*b*, 31*c*, and 31*d*. Similarly, the electrodes 33*a* and 32*a*, 33*b* and 32*b*, 33*c* and 32*c*, and 33*d* and 32*d* may be connected together via respective capacitors. The axial voltage $\phi_2$ may be applied to all of the electrodes 33*a*, 33*b*, 33*c*, and 33*d*.

Only precursor ions selected according to the selection voltages (RF voltage and DC voltage) remain on the optical axis 62 and enter the collision cell 40. Product ions created by the cell 40 enter the second mass analyzer 50 together with unfragmented precursor ions.

The quadrupole mass filter 52 is mounted in the second mass analyzer 50. A pre-filter 51 and a post-filter 53 are mounted respectively before and after the mass filter 52 to select and pass only ions of a desired mass-to-charge ratio. The pre-filter 51 and post-filter 53 serve as ion guides and are located respectively before and after the quadrupole mass filter 52 to thereby enhance the ion transmission efficiency. Selection voltages (RF voltage and DC voltage) and an axial voltage are supplied to the quadrupole mass filter 52 to select ions according to mass-to-charge ratio from the power supply 80. Desired axial voltages are supplied to the pre-filter 51 and post-filter 53 also from the power supply 80. The selection voltages (RF voltage and DC voltage) and axial voltage applied to the quadrupole mass filter 52 and the axial voltages applied to the pre-filter 51 and post-filter 53 are similar to the voltages applied to the quadrupole mass filter 32, pre-filter 31, and post-filter 33 shown in FIG. 6. The RF voltage, DC voltage, and axial voltage V4 for the second mass analyzer 50 can be defined similarly to the case of the first mass analyzer 30. Product ions or precursor ions selected according to the selection voltages (RF voltage and DC voltage) remain on the optical axis 62 and enter the detector 60.

In the present modified embodiment, too, the axial voltages on the pre-filter 31, quadrupole mass filter 32, and post-filter 33 are varied in such a way that those of the ions selected by the first mass analyzer 30 which have larger masses have larger kinetic energies in the direction of the optical axis 62 as they pass through the first mass analyzer 30. The times taken for the ions to pass through the first mass analyzer 30 are made substantially the same regardless of mass-to-charge ratio. Similarly, the axial voltages on the pre-filter 51, quadrupole mass filter 52, and post-filter 53 are so varied that ions having larger masses have larger kinetic energies in the direction of the optical axis 62 as they pass through the second mass analyzer 50. The times taken for the ions to pass through the second mass analyzer 50 are made substantially the same regardless of mass-to-charge ratio. Therefore, in the present modified embodiment, too, the axial voltage V2 is varied based on Eq. (2) or a previously created table or mathematical formula and according to the mass-to-charge ratio of the selected ions. The axial voltage V4 is varied based on Eq. (4) or a previously created table or mathematical formula and according to the mass-to-charge ratio of the selected ions.

Other operations of the mass spectrometer according to this modified embodiment are identical to the corresponding operations of the mass spectrometer of the first embodiment and so their description is omitted. Each of the first mass analyzer 30 and the second mass analyzer 50 may be provided with any one of a pre-filter and a post-filter. Furthermore, a pre-filter and a post-filter may be mounted only in one of the first mass analyzer 30 and the second mass analyzer 50.

Modified Embodiment 2

Figure 7:
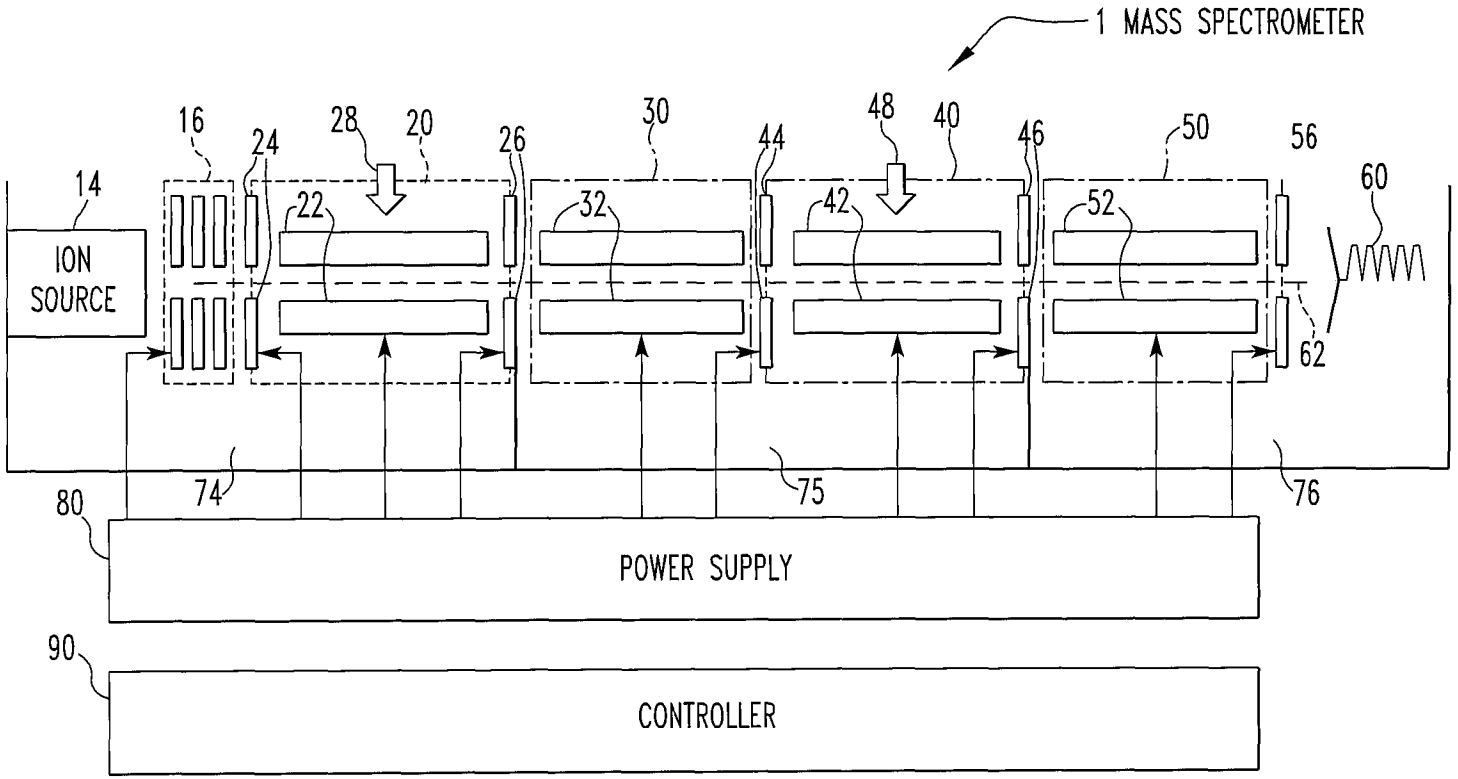
FIG. 7 is a diagram showing the configuration of a mass spectrometer according to modified second embodiment.

As shown in FIG. 7, instead of an atmospheric-pressure ion source, an ion source for ionizing a sample in a vacuum such as an electron-impact ionization source that ionizes the sample by causing electrons to collide against the sample may be used. Those components shown in FIG. 7 which are identical in configuration to their counterparts of FIG. 1 are indicated by the same reference numerals as used in FIG. 1 and so their description is omitted.

A mass spectrometer 1 according to Modified Embodiment 2 shown in FIG. 7 has an ion source 14 instead of the ion source 10. A condenser lens assembly 16 consisting of electrodes is mounted between the ion source 14 and the entrance electrode 24 of the ion storage portion 20. A first differential pumping chamber 74 is defined from the ion source 14 to the exit electrode 26 of the storage portion 20. A second differential pumping chamber 75 is defined from the exit electrode 26 of the storage portion 20 to the exit electrode 46 of the collision cell 40. A third differential pumping chamber 76 is formed in the space located behind the exit electrode 46 of the cell 40.

Ions created by the ion source 14 pass through the condenser lens assembly 16 and enter the ion storage portion 20. Because the ion source 14 is in a vacuum, gas is introduced from the gas inlet means 28 into the storage portion 20 to lower the kinetic energies of ions, thus enhancing the storage efficiency. The storage portion 20 repeatedly performs an operation for storing ions and an operation for ejecting stored ions as pulsed ions. The pulsed ions ejected from the storage portion 20 enter the first mass analyzer 30. This mass spectrometer is similar in other operations to the mass spectrometer of the first embodiment and so their description is omitted.

The present invention embraces configurations substantially identical (e.g., in function, method, and results or in purpose and advantageous effects) to the configurations described in the preferred embodiments of the invention. Furthermore, the invention embraces the configurations described in the embodiments including portions which have replaced non-essential portions. In addition, the invention embraces configurations which produce the same advantageous effects as those produced by the configurations described in the preferred embodiments or which can achieve the same objects as the objects of the configurations described in the preferred embodiments. Further, the invention embraces configurations which are the same as the configurations described in the preferred embodiments and to which well-known techniques have been added.

Having thus described my invention with the detail and particularity required by the Patent Laws, what is desired protected by Letters Patent is set forth in the following claims.

The invention claimed is:

1. A mass spectrometer comprising:

an ion source for ionizing a sample to create ions;

an ion storage portion for storing the created ions and ejecting the stored ions as pulsed ions;

a first mass analyzer for selecting first desired ions from the pulsed ions ejected from the storage portion based on mass-to-charge ratio;

a collision cell for fragmenting some or all of the first desired ions into product ions;

a second mass analyzer for selecting second desired ions from the first desired ions and the product ions based on mass-to-charge ratio;

a detector for detecting the second desired ions; and a controller for providing control such that those of the first desired ions which have larger masses have larger kinetic energies in the direction of an optical axis in the first mass analyzer and that those of the second desired ions which have larger masses have larger kinetic energies in the direction of the optical axis in the second mass analyzer.

2. The mass spectrometer of claim 1, wherein said controller varies the axial voltage on the first mass analyzer according to the mass-to-charge ratio of the first desired ions to thereby vary the kinetic energies of the first desired ions in the direction of the optical axis, and wherein said controller varies the axial voltage on the second mass analyzer according to the mass-to-charge ratio of the second desired ions to thereby vary the kinetic energies of the second desired ions in the direction of the optical axis.

3. The mass spectrometer of claim 2, wherein said controller varies the axial voltage on the first mass analyzer based on a mathematical formula or table indicating a relationship between the mass-to-charge ratio of the first desired ions and the axial voltage on the first mass analyzer, and wherein said controller varies the axial voltage on the second mass analyzer based on a mathematical formula or table indicating a relationship between the mass-to-charge ratio of the second desired ions and the axial voltage on the second mass analyzer.

4. The mass spectrometer of any one of claims 1 to 3, wherein in a case where said first mass analyzer selects different ones of said first desired ions in response to two pulsed ions ejected in succession from the ion storage portion, said controller provides control such that an instant at which the selection of the first desired ions is started to be varied is later than an instant at which a previous pulsed ion finishes passing through the first mass analyzer and that an instant at which the selection of the first desired ions ends is earlier than an instant at which a following pulsed ion starts to pass through the first mass analyzer, and wherein in a case where said second mass analyzer selects different ones of said second desired ions in response to two pulsed ions entering in succession from the collision cell, the controller provides control such that an instant at which the selection of the second desired ions is started to be varied is later than an instant at which a previous ion pulse finishes passing through the second mass analyzer and that an instant at which the selection of the second desired ions ends is earlier than an instant at which a following pulsed ion starts to pass through the second mass analyzer.

5. The mass spectrometer of any one of claims 1 to 3, wherein said ion storage portion stores the ions created by the ion source and ejects the stored pulses as pulsed ions at regular intervals of time.

6. The mass spectrometer of any one of claims 1 to 3, wherein said collision cell stores said first desired ions and said product ions and ejects the stored ions as pulsed ions.

7. The mass spectrometer of any one of claims 1 to 3, wherein said ion storage portion stores the ions created by the ion source and ejects the stored pulses as pulsed ions at regular intervals of time, and wherein said collision cell stores said first desired ions and said product ions and ejects the stored ions as pulsed ions at regular intervals of time equal to the first-mentioned intervals of time.

8. The mass spectrometer of claim 6, wherein in a case where said first mass analyzer varies the mass-to-charge ratio of said first desired ions, said collision cell ejects all of ions present within the collision cell by an operation for ejecting a last pulsed ion prior to the variation.

9. The mass spectrometer of claim 7, wherein in a case where said first mass analyzer varies the mass-to-charge ratio of said first desired ions, said collision cell ejects all of ions present within the collision cell by an operation for ejecting a last pulsed ion prior to the variation.

10. The mass spectrometer of claim 6, wherein in a case where said first mass analyzer varies the mass-to-charge ratio of said first desired ions, said collision cell makes longer a time for which a last pulsed ion prior to the variation is ejected than a time for which other pulsed ions are ejected prior to the variation.

11. The mass spectrometer of claim 7, wherein in a case where said first mass analyzer varies the mass-to-charge ratio of said first desired ions, said collision cell makes longer a time for which a last pulsed ion prior to the variation is ejected than a time for which other pulsed ions are ejected prior to the variation.

12. The mass spectrometer of claim 6, wherein said collision cell stores said first desired ions and said product ions while the first desired ions are entering the cell.

13. The mass spectrometer of claim 7, wherein in a case where said first mass analyzer varies the mass-to-charge ratio of said first desired ions, said collision cell makes longer a time for which a last pulsed ion prior to the variation is ejected than a time for which other pulsed ions are ejected prior to the variation.

14. The mass spectrometer of claim 8, wherein in a case where said first mass analyzer varies the mass-to-charge ratio of said first desired ions, said collision cell makes longer a time for which a last pulsed ion prior to the variation is ejected than a time for which other pulsed ions are ejected prior to the variation.

15. The mass spectrometer of claim 9, wherein in a case where said first mass analyzer varies the mass-to-charge ratio of said first desired ions, said collision cell makes longer a time for which a last pulsed ion prior to the variation is ejected than a time for which other pulsed ions are ejected prior to the variation.

16. The mass spectrometer of any one of claims 1 to 3, wherein said first mass analyzer includes a first quadrupole mass filter for selecting the first desired ions, and wherein said second mass analyzer includes a second quadrupole mass filter for selecting the second desired ions.

17. The mass spectrometer of claim 16, wherein said first mass analyzer includes at least one of a pre-filter and a post-filter located respectively before and after the first quadrupole mass filter, and wherein said second mass analyzer includes at least one of a pre-filter and a post-filter located respectively before and after the second quadrupole mass filter.

* * * * *